US006511953B1

(12) United States Patent
Fontana et al.

(10) Patent No.: US 6,511,953 B1
(45) Date of Patent: Jan. 28, 2003

(54) HARD SURFACE CLEANERS

(75) Inventors: Cinzia Fontana, Casale (IT); Luciano Novita, Casale (IT)

(73) Assignee: Unilever Home & Personal Care USA, a division of Conopco, Inc., Greenwich, CT (US)

( * ) Notice: Subject to any disclaimer, the term of this patent is extended or adjusted under 35 U.S.C. 154(b) by 0 days.

(21) Appl. No.: 09/719,297

(22) PCT Filed: Jun. 2, 1999

(86) PCT No.: PCT/EP99/03844

§ 371 (c)(1),
(2), (4) Date: Feb. 20, 2001

(87) PCT Pub. No.: WO99/64553

PCT Pub. Date: Dec. 16, 1999

(30) Foreign Application Priority Data

Jun. 9, 1998 (EP) ..... 98304566

(51) Int. Cl.[7] ..... C11D 3/00; C11D 3/395; C11D 7/54

(52) U.S. Cl. ..... 510/369; 510/380

(58) Field of Search ..... 510/367, 368, 510/369, 379, 380

(56) References Cited

U.S. PATENT DOCUMENTS

| | | | |
|---|---|---|---|
| 3,577,347 | A | 5/1971 | Monick |
| 4,438,016 | A | 3/1984 | Kiewert et al. |
| 4,913,833 | A | 4/1990 | Otten et al. |
| 5,130,043 | A | 7/1992 | Prince et al. |
| 5,279,755 | A | 1/1994 | Choy et al. |

FOREIGN PATENT DOCUMENTS

| | | |
|---|---|---|
| EP | 0 009 942 | 4/1983 |
| EP | 0 159 923 | 12/1989 |
| EP | 0 346 112 | 12/1989 |
| EP | 0 649 898 | 4/1995 |
| EP | 0 724 011 | 7/1996 |
| EP | 0 812 908 | 12/1997 |
| EP | 0 829 530 | 3/1998 |
| EP | 0 520 226 | 10/2000 |
| GB | 2 311 996 | 10/1997 |

OTHER PUBLICATIONS

International Search Report dated Sep. 23, 1999.

*Primary Examiner*—Yogendra N. Gupta
*Assistant Examiner*—John M Petruncio
(74) *Attorney, Agent, or Firm*—Ronald A. Koatz

(57) ABSTRACT

The invention concerns hard surface cleaning compositions comprising a halogen bleaching agent and a surfactant system, wherein the surfactant system consists of or comprises at least one ethoxylated nonionic surfactant carrying a terminal OH group in an amount of more than 0.2% by weight of the composition and the composition comprises a buffer system to maintain the pH at or above 11.5. The surfactant system preferably comprises a mixture of anionic and nonionic surfactants. The compositions preferably additionally comprise an abrasive.

1 Claim, No Drawings

HARD SURFACE CLEANERS

TECHNICAL FIELD

The present invention relates to liquid hard surface cleaners, and in particular to hard surface cleaners which contain bleach.

BACKGROUND TO THE INVENTION

Hard surface cleaners containing bleach are well known in the art. Typical compositions comprise one or more surfactants in solution and a bleaching agent such as a it hypochlorite salt. Such hard surface cleaners typically are rather viscous liquids such that when they are applied to a tilted or vertical surface they do not run off immediately, but rather cling to the surface and only gradually drain off thus extending their action on that surface.

Theta may contain other components as well, particularly an abrasive. The abrasive particles should stay suspended in the liquid so that sedimentation of the particles is presented and the product need not be shaken before use.

Often, the required thickening of the liquid cleaner is the result of a proper selection of the surfactant or surfactants, which in combination with other ingredients present in the product or with each other provide for the thickening effect.

Bleach is present in the product because it is very effective in removing oxidizable stains and against microbes and molds. The principal problem normally associated with the presence of bleach is oxidation of other components of the formulation thereby reducing its effectiveness. Excessive decomposition of hypochlorite may also cause the product to foam and pressure to build up in the container of the product.

Thus in EP-A-0 009 942, which describes liquid cleaning compositions containing abrasive and chlorine bleach, it is stressed that that the surfactants should be resistant to oxidation by the bleach. Particularly the ethoxylated nonionic surfactants are mentioned as being unsuitable because of their susceptibility to oxidation. The need to use bleach stable surfactants, particularly bleach stable nonionic surfactants, is also stressed in U.S. Pat. No. 5,279,755, which again describes bleach containing liquid abrasive cleaning compositions. Similar disclosures can be found in EP-A-0 159 923, U.S. Pat. No. 4,438,016 and EP-A-0 649 898. All of these references describe the use of a mixture of anionic and bleach stable nonionic surfactants as being particularly suitable. Tertiary amine oxides are generally recognized as being particularly stable against bleach and very suitable for the above purpose.

U.S. Pat. No. 3,577,347 describes solid cleaning compositions comprising a surfactant, a chlorine bleach and a water soluble salt as abrasive. Large groups of anionic and nonionic surfactants are listed as suitable, among which ethoxylated alkylphenols and ethoxylated fatty alcohols. However, it is stressed that in order to remain stable the composition should not contain an appreciable amount of water and the water soluble salt should therefor have less than 6 molecules of water of hydration.

EP-A-0 346 112 discloses machine diswashing compositions containing hypochlorite bleach. The compositions also contain detergent surfactants of which it is stressed that they should be bleach stable. A general description of a wide variety of possible nonionic surfactants, including fatty alcohol ethoxylates, ends with the remark that some of them are bleach stable and some are not. It is then said that in order to be bleach stable the nonionic detergent compound should not contain free OH groups, i.e. it should be "capped" with a low alcohol moiety. Also the compositions should preferably have pH between 10.5 and 12.5 to minimize chemical interaction between the detergent and the bleach.

Similar compositions are described in U.S. Pat. No. 5,130,043 which also contain alkoxylated nonionics which are capped, i.e. do not contain a free terminal OH group.

Further examples of the use of capped alkoxylated nonionic surfactants in combination with hypochlorite bleach may be found in EP-A-0 812 908.

EP-A-0 520 226 describes acidic halogen bleach compositions which contain limited amounts of ethoxylated alkylphenols as chlorine scavenger. This shows the ease with which these compounds react with halogen.

Nonionic surfactants which are generally considered to be bleach stable are not always the most desirable ones to be used in cleaning compositions. Thus, amine oxides are generally more expensive than e.g. ethoxylated aliphatic alcohols. Also, the latter are generally considered to be excellent detergents especially for removing fatty soils.

BRIEF DESCRIPTION OF THE INVENTION

It has now been found that stable aqueous liquid hard surface cleaning compositions can be prepared, comprising a halogen bleach and an ethoxylated nonionic surfactant and which is buffered so as to maintain the pH of the composition at 11.5 or above.

Accordingly, the present invention provides aqueous liquid hard surface cleaning compositions comprising a halogen bleaching agent and a surfactant system, wherein the surfactant system consists of, or comprises, at least one ethoxylated nonionic surfactant carrying a terminal OH group and the composition comprises a buffer system to maintain the pH at or above 11.5.

The formulations described herein provide cleaning compositions which are stable under the normally encountered storage temperatures and during normally encountered periods of storage and use, and exhibit good cleaning properties and rheology.

DETAILED DESCRIPTION OF THE INVENTION

As outlined above the cleaning compositions contain at least a halogen bleaching agent, a surfactant system and a buffer system. Other components may be present as well, as will be described hereinafter, to give the compositions additional useful properties. One such component, which is highly desirable for certain types of hard surface cleaning compositions is an abrasive system consisting of a plurality of solid abrasive particles.

Bleaching Agent

The compositions of the invention contain a halogen bleaching agent. The bleach is preferably selected from the group consisting of the alkali metal and the alkaline earth metal salts of hypohalite, hypohalite addition compounds, haloamines, haloimines, haloimides, and haloamides. Chlorine based bleaching agents such as hypochlorite are particularly preferred. Typical hypochlorite compounds include sodium, potassium, lithium and calcium hypochlorite, chlorinated trisodium phosphate dodecahydrate, potassium and sodium dichloro-isocyanurate, trichloroisocyanuric acid, dichlorodimethyl hydantoin, chloro-bromo-dimethylhydantoin, N-chlorosulfamide and chloramine. In the context of the present invention sodium hypochlorite (NaOCl) is particularly preferred.

The levels of bleach (expressed as % wt available halogen) present in the formulation are suitably at least 0.25 wt % of the total formulation, more preferably at least 0.5%. Generally the levels do not exceed 15 wt % and are preferably at or below 5 wt %, most preferably at or below 3 wt %.

Surfactant System

Ethoxylated nonionic surfactants carrying a terminal OH group are essential ingredients of the compositions according to the present invention. Suitable ethoxylated nonionic surfactants can be broadly described as compounds comprising ethyleneoxy groups, which are hydrophilic, and an organic hydrophobic group which may be aliphatic or alkyl aromatic in nature. The length of the hydrophilic polyoxyethylene group which is attached to any particular hydrophobic group can be readily adjusted to yield a water-soluble compound having the desired balance between hydrophilic and hydrophobic elements. This enables the choice of nonionic surfactants with a suitable HLB.

The hydrophobic group may be derived from primary or secondary alcohols having 8–22 C-atoms or from alkylphenols containing an alkyl group of 6–15 C-atoms. These compounds may be condensed with up to 15 moles of ethylene oxide. The alcohols may be saturated or unsaturated.

The hydrophobic group may also be derived from alkylpolyglucosides, alkoxylated alcohols, alkyl sulphoxides, alkyl-polyglycerols, fatty acid esters, amides and amines Preferred nonionic surfactants are selected from the group comprising ethoxylated alcohols of the general formula:

$$R^1—(OCH_2CH_2)_m—A—OH$$

wherein R is the residue of a branched or unbranched alcohol having 8–18 C-atoms; A is absent or is the residue of a polyol of at least 2 C-atoms and two hydroxyl groups; and the average degree of ethoxylation (i.e. the ethyleneoxy chain length) m is 1–10. $R^1$ can be a 2-hydroxy-alkyl group of the same chain length.

Where A is present it can be the residue of an alkylene glycol or a sugar. Preferably A is be absent. It should be noted that propoxy residues can partly replace the ethoxy residues. $R^1$ is preferably a primary group.

The alcohol ethoxylates are excellent detergents, are available at low cost and exhibit concentration-sensitive interactions with electrolytes having a desirable thickening effect on the cleaning composition.

The level of nonionic surfactant is at least 0.1%, generally more than 0.2% by weight, preferably at least 0.25% and more preferably at least 0.4% by weight. Generally the amount will not be more than 10% by weight, more preferably at or below 5%, most preferably at most 4% by weight.

It is preferred that the compositions according to the invention also contain an anionic surfactant. Suitable anionic surfactants are water-soluble salts of organic sulphuric acid esters and of sulphonic acids which have in the molecular structure an alkyl group containing 6–22 C-atoms.

Examples of such anionic surfactants are water soluble salts of:

- long chain (i.e. 8–22 C-atom) alcohol sulphates (hereinafter referred to as PAS), especially those obtained by sulphating the fatty alcohols produced by reducing the glycerides of tallow or coconut oil;
- alkyl benzene sulphonates, such as those in which the alkyl group contains from 6 to 20 carbon atoms;
- secondary alkanesulphonates (hereinafter referred to as SAS).

Also suitable are salts of:

- alkyl glyceryl ether sulphates, especially those ethers of the fatty alcohols derived from tallow and coconut oil;
- fatty acid monoglyceride sulphates;
- sulphates of the reaction product of one mole of a fatty alcohol and from 1 to 6 moles of ethylene oxide;
- salts of alkylphenol ethyleneoxy-ether sulphates with from 1 to 8 ethyleneoxy units per molecule and in which the alkyl groups contain from 4 to 14 carbon atoms;

and mixtures thereof.

Particularly suitable are ether sulphates having the formula given below:

$$R^2—(OCH_2CH_2)^n—OSO_3X$$

in which $R^2$ is a residue of branched or unbranched, preferably primary, alcohols with a (mean) chain length of 8–20 C-atoms, n is from 1 to 10, and X is a solubilising cation. Suitable cations include sodium, magnesium, potassium, ammonium and mixtures thereof. Preferably $R^2$ has a chain length of 8–16 C-atoms. It is also advantageous if n is from 1 to 5.

The level of anionic surfactant is preferably at least 0.1% by weight of the total cleaning composition, more preferably at least 0.5 and most preferably at least 1.0%. Generally, the amount will not exceed 15% by weight, more preferably it will be at most 10% and most preferably at most 5%.

In preferred embodiments of the invention the total surfactant system comprises from 1 to 15% by weight of the total cleaning composition. In particularly preferred surfactant systems the weight ratio of anionic surfactant to nonionic surfactant is below 5:1 or even below 4:1, whereas on the other hand it is preferably not below 1:1, more preferably not below 2:1.

Surfactant systems such as those described above generally have a thickening effect which provides the cleaning composition with a desirable viscosity. This can be further improved by adding to the composition., over and above any anionic surfactant already present as described above, up to % by weight of fatty acid or fatty acid soap having 10–18 C-atoms. Preferred amounts are at least 0.1% by weight or even 0.2%, but do rarely need to exceed 1%. It is particularly preferred that the ratio of soap to total surfactant system should fall in the range of 1:4–1:20.

These fatty acids/soaps also help to prevent excessive foaming of the compositions in use.

Buffer System

The third essential ingredient of the cleaning compositions according to the invention is a buffer system which keeps the pH of the compositions at or above 11.5, not only during production of the compositions but also during its effective lifetime. For the purposes of this invention a buffer system is defined as a mixture of ingredients which is able to keep the pH at or above the required level.

Preferably he pH should be kept at or above 12, more preferably at or above 12.5. Such buffers are known in the art and are generally made up of highly alkaline compounds such as alkali metal hydroxides and alkali metal salts of weak acids. Suitable buffer systems comprise mixtures of alkali metal hydroxide and alkali metal silicate, particularly alkaline sodium silicate wherein the $Na_2O/SiO_2$ ratio is 1:1 or above, preferably 1.5:1 or above. A particularly suitable buffer system comprises 0.2–0.6% of NaOH and a suitable amount of alkaline Na silicate (e.g. 0.1–3% wt.) to maintain the required pH.

Additional Components

Abrasive:

Particularly preferred embodiments of the cleaning compositions according to the present invention additionally comprise an abrasive system, i.e. a dispersed, suspended phase of a particulate abrasive which is either insoluble in the aqueous phase or present in such excess that the solubility of the abrasive in the aqueous phase is exceeded and consequently solid abrasive particles exist in the composition.

Preferred abrasives for use in general purpose cleaning compositions have a Moh hardness below 6 although higher hardness abrasives can be employed for specialist applications.

Suitable abrasives can be selected from: zeolites, silicas, silicates, carbonates, aluminas, bicarbonates, borates, sulphates and polymeric materials such as polyethylene. The most preferred abrasives are calcium carbonate (as calcite), mixtures of calcium and magnesium carbonates (as dolomite), sodium hydrogen carbonate, potassium sulphate, zeolite, alumina, hydrated alumina, feldspar, talc and silica. Calcite and dolomite are particularly preferred dues to their low cost, hardness and colour.

Preferred weight average particle sizes for the abrasive fall in the range 0.5–200 microns, with values of around 10–100 microns being particularly preferred. In this range an acceptable compromise between good cleaning behaviour and low substrate damage is achieved.

Preferred levels of abrasive range from 5–70wt % of the total cleaning composition, preferably in the range 15–50% most preferably between 30–50%. Such levels of abrasive give effective cleaning and good rinsing.

The thickening effect obtained by the preferred surfactant systems will also provide for keeping the abrasive particles in stable suspension in the cleaning composition.

Electrolyte:

The thickening effect of the surfactant system and thus also the stability of the suspension of abrasive particles, if present, is further supported by the presence of electrolyte in the compositions of he invention.

Such electrolytes may be selected from salts of monovalent or polyvalent organic or inorganic acids. Thus, suitable monovalent anions are selected from the group comprising chlorides, bromides, iodides, acetates, bicarbonates and mixtures thereof, and suitable polyvalent anions are selected from the group comprising, carbonates, citrates, sulphates and mixtures thereof. Carbonates alone, or mixtures comprising carbonates are particularly preferred. As will be apparent to a person skilled in the art, the choice of the electrolyte or electrolytes is also governed by the chemical nature of the other components present in the compositions of the invention, so as to prevent any adverse reaction therewith.

For the longer chain ethoxylated alcohols, wherein m (the average degree of ethoxylation) is greater than 5, monovalent anion electrolyte may need to be present in weight excess over the total surfactant present in the composition, whereas electrolytes with either monovalent or polyvalent anions can be used with the shorter chain ethoxylates (i.e. where m is less than or equal to 5).

Preferred levels of electrolyte fall n the range 1–10%, more preferably 2–8%. It is particularly preferred that the anions of the electrolyte comprise at least 50 mol % is carbonate.

Thickening agents:

High molecular weight hydrophilic polymers are optional ingredients of compositions according to the present invention and may help in further providing desirable physical characteristics. Particularly, they may act as thickeners and provide suspension stability for any abrasive which may be present. They should be compatible with bleach. Suitable polymers include polyacrylates. If present, the hydrophilic polymer suitably has an average molecular weight in excess of 500,000 Dalton and be present at levels of between 0.01 and 2% of the total composition.

Certain inorganic materials can also be used as thickening agents, such as colloidal aluminium oxide, colloidal silica and montmorillonite.

Minors:

The compositions of the invention can further comprise other non-essential components such as: perfumes, colours, whitening agents (e.g. titanium dioxide), dyes and foam-control agents.

Having regard to the various constraints and preferred features, particularly preferred embodiments of the present intention provide stable, liquid compositions comprising an aqueous phase and 30–50% by weight of a suspended particulate phase comprising calcite, dolomite, silica or mixtures thereof, and the aqueous phase comprises (in % by weight of the total composition):

a) 2–10% of a surfactant system comprising at least one of:

$$R^1—(OCH_2CH_2)_m—OH \quad \text{i)}$$

wherein $R^1$ is the residue of a branched, or unbranched, preferably primary, alcohol having 8–18 C-atoms and the average degree of m is 1–10;

and at least one of:

$$R^2—(OCH_2CH_2)_n—OSO_3X \quad \text{ii)}$$

in which $R^2$ is a residue of branched or unbranched, preferably primary, alcohols with a chain length of 8–20 C-atoms, n is from 0 to 5, and X is a solubilising cation;

or:

secondary alkanesulphonates having an alkyl group of 8–22 C-atoms;

wherein the ratio of i to ii is between 1:1 and 1:4.

b) 0.25–5% of NaOCl.

c) 0.3–2.5% of a buffer system comprising NaOH and Na silicate.

d) 1–10% of an electrolyte said electrolyte comprising 25–100 mol % of multivalent anions selected from carbonate, citrate, sulphate and mixtures thereof.

e) 0.2–0.8% of fatty acid or fatty acid soap having 10–18 C-atoms.

The invention is further elucidated by the following example.

EXAMPLE

An aqueous liquid abrasive cleaning compositions was prepared containing the following components in the given amounts (in % by weight of the total composition). The compounds were added in the order given in the table.

| | |
|---|---|
| Demineralised water | 44.145 |
| Na carbonate | 4.00 |

-continued

| | |
|---|---|
| Silicone DB31 | 0.005 |
| Anionic: Na LES 1 EO | 2.80 |
| Nonionic: C9–C11 5 EO (Neodol 91-5 ™) | 0.85 |
| NaOH | 0.40 |
| Fatty acid (Prifac 7907 ™) | 0.35 |
| Alkaline Na silicate ($Na_2O:SiO_2$ = 2) | 1.00 |
| Calcite (Omyacarb 30AV ™) | 45.00 |
| Na hypochlorite | 1.20 |
| Perfume | 0.25 |

The initial water temperature was brought to 26–30° C. and the components were mixed using a static mixer. During the addition of the fatty acid the temperature was kept above 32°, while during the addition of the bleach and the perfume the temperature was kept below 34° C.

The product had pH 13.0.

The cleaning composition obtained was shown to be more stable as to the content of available chlorine than a comparable market product containing an amine oxide as the nonionic surfactant.

What is claimed is:

1. Aqueous liquid hard surface cleaning composition comprising an aqueous phase and 30–50% by weight of a suspended particulate phase comprising calcite, dolomite, silica or mixtures thereof, and the aqueous phase comprises (in % by weight of the total composition):

a) 2–10% of a surfactant system comprising at least one of:

$$R^1—(OCH_2CH_2)_m—OH \quad \text{i)}$$

wherein $R^1$ is the residue of a branched, or unbranched, aliphatic primary alcohol having 8–18 C-atoms and the average degree of m is 1–10; and at least one of:

$$R^2—(OCH_2CH_2)_n—OSO_3X \quad \text{ii)}$$

in which $R^2$ is a residue of branched or unbranched, aliphatic primary alcohols with a chain length of 8–20 C-atoms, n is from 0 to 5, and X is a solubilising cation;

or:

secondary alkanesulphonates having an alkyl group of 8–22 C-atoms;

wherein the ratio of i to ii is between 1:1 and 1:4, b) 0.25–5% of NaOCl, c) 0.3–2.5% of a buffer system comprising NaOH and Na silicate, d) 1–10% of an electrolyte said electrolyte comprising 25–100 mol % of multivalent anions selected from carbonate, citrate, sulphate and mixtures thereof, e) 0.2–0.8% of fatty acid or fatty acid soap having 10–18 C-atoms.

* * * * *